US009389536B2

(12) United States Patent
Suzuki

(10) Patent No.: US 9,389,536 B2
(45) Date of Patent: Jul. 12, 2016

(54) IMAGE FORMING APPARATUS

(71) Applicant: CANON KABUSHIKI KAISHA, Tokyo (JP)

(72) Inventor: Hideaki Suzuki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/621,647

(22) Filed: Feb. 13, 2015

(65) Prior Publication Data

US 2015/0234321 A1 Aug. 20, 2015

(30) Foreign Application Priority Data

Feb. 19, 2014 (JP) ..... 2014-029512

(51) Int. Cl.
*G03G 15/08* (2006.01)
*G03G 15/00* (2006.01)

(52) U.S. Cl.
CPC ..... *G03G 15/0822* (2013.01); *G03G 15/0834* (2013.01); *G03G 15/0848* (2013.01); *G03G 15/0865* (2013.01); *G03G 15/0877* (2013.01); *G03G 15/0889* (2013.01); *G03G 15/5054* (2013.01)

(58) Field of Classification Search
CPC ..... G03G 15/0822; G03G 15/0834; G03G 15/0865; G03G 15/0877; G03G 15/0887
See application file for complete search history.

(56) References Cited

U.S. PATENT DOCUMENTS

| | | | |
|---|---|---|---|
| 6,292,640 | B1 | 9/2001 | Suzuki |
| 6,330,411 | B1 | 12/2001 | Suzuki |
| 7,010,237 | B2 | 3/2006 | Suzuki et al. |
| 7,092,647 | B2 | 8/2006 | Suzuki |
| 7,512,348 | B2 | 3/2009 | Suzuki et al. |

FOREIGN PATENT DOCUMENTS

| | | | |
|---|---|---|---|
| JP | H05-061353 | A | 3/1993 |
| JP | 2006-119479 | A | 5/2006 |
| JP | 2009-116096 | A | 5/2009 |
| JP | 2009-175417 | A | 8/2009 |

*Primary Examiner* — David Gray
*Assistant Examiner* — Andrew V Do
(74) *Attorney, Agent, or Firm* — Fitzpatrick, Cella, Harper & Scinto

(57) ABSTRACT

A control portion of this image forming apparatus can selectively execute first and second modes. The first mode is a mode of forming a controlling toner image in an inter-image period until when a succeeding electrostatic latent image is developed after when a preceding electrostatic latent image is developed. The second mode is executed with priority over the first mode in a case when the integrated value of the values related to the toner replenishing amount is greater than a predetermined threshold value.

9 Claims, 11 Drawing Sheets

IMAGE FORMING APPARATUS

BACKGROUND OF THE INVENTION

1. Field of the Invention

The present invention relates to an image forming apparatus such as a copier, a printer, a facsimile, and a multi-function printer having a plurality of functions of those apparatuses and using an electro-photographic or electrostatic recording system.

2. Description of the Related Art

A two-component developer whose main components are toner and carrier is widely used for a developing apparatus provided in an electro-photographic or electro-static recording image forming apparatus. Because the toner within the developer is consumed during developments, toner concentration, i.e., a ratio of weight of the toner with respect to total weight of the carrier and the toner, varies as images are formed. Due to that, there is known a system controlling the toner concentration to an adequate range by replenishing the developer corresponding to changes of the toner concentration since the past as disclosed in Japanese Patent Application Laid-open No. H05-61353 for example.

There is also a possibility that the toner concentration within the developing apparatus drops sharply if images whose image ratio is high are consecutively formed. Then, hitherto, there is a control system interrupting an image forming operation and adjusting the toner concentration within the developing apparatus by forming a control patch when it is determined that a large amount of the toner is consumed based on information related to the toner consumption (toner replenishing amount) during a consecutive image forming job.

Even if the toner concentration can be adjusted by replenishing the developer as described above in the two-component developer system, the following problem may occur if the developer replenishing amount per unit sheet is excessive. That is, lately, the toner used in the two-component developer is endowed with low-temperature fixability from an aspect of energy saving. Such toner tends to coagulate and to form agglomerates when temperature rises. For instance, if a toner container storing such toner is left in a high-temperature and high-humidity place for a long period of time, there is a possibility that a large number of agglomerates is generated within the toner container.

If the developer is replenished from the toner container including the large number of such agglomerates into the developing apparatus, there is a case when the agglomerates contained in the replenished developer are held on a developing sleeve without being crushed in an agitating path within the developing apparatus. In such a case, there is a possibility that non-charged toner is developed where the agglomerates are held and an image is stained. Such stains tend to be remarkable in the case when the toner replenishing amount is excessive per unit sheet like a case when a plurality of images is formed consecutively with high image ratio. It is considered to happen because the agglomerates are not fully crushed due to lack of time of fully agitating and dispersing the developer within the developing apparatus because the toner is replenished continuously.

Still further, the agglomerates may not be fully crushed because the conventional control mode executed in a case when the toner consumption (replenishing amount) is large is carried out to adjust concentration and not to crush the agglomerates.

SUMMARY OF THE INVENTION

According to one aspect of the invention, an image forming apparatus includes an image carrier; a developing apparatus including: a developer container configured to store developer containing toner and carrier; an agitating member rotating and agitating the developer within the developer container, the developing apparatus developing an electrostatic latent image formed on the image carrier by the toner at a developing position and forming a toner image; a developer replenishing apparatus configured to replenish the developer to the developer container corresponding to a toner consumption amount; a control portion capable of selectively executing first and second modes, the first mode being a mode of forming a controlling toner image between a succeeding image and a preceding image in a case when a number of image forming sheets is more than a predetermined threshold number during a consecutive image forming job in which images are formed consecutively on recording media, and the second mode being a mode of driving the agitating member such that a total number of rotations of the agitating member in a period until when the succeeding image reaches the developing position after when the preceding image passes the developing position is greater than a total number of rotations of the agitating member in the first mode in a case when the integrated value of the values related to the toner replenishing amount is greater than the predetermined threshold value during the consecutive image forming job in which the images are formed consecutively on the recording media; and a resetting portion resetting the integrated value in a case when the second mode is executed.

Further features of the present invention will become apparent from the following description of exemplary embodiments with reference to the attached drawings.

DESCRIPTION OF THE EMBODIMENTS

<Common Structure>

Figure 1:
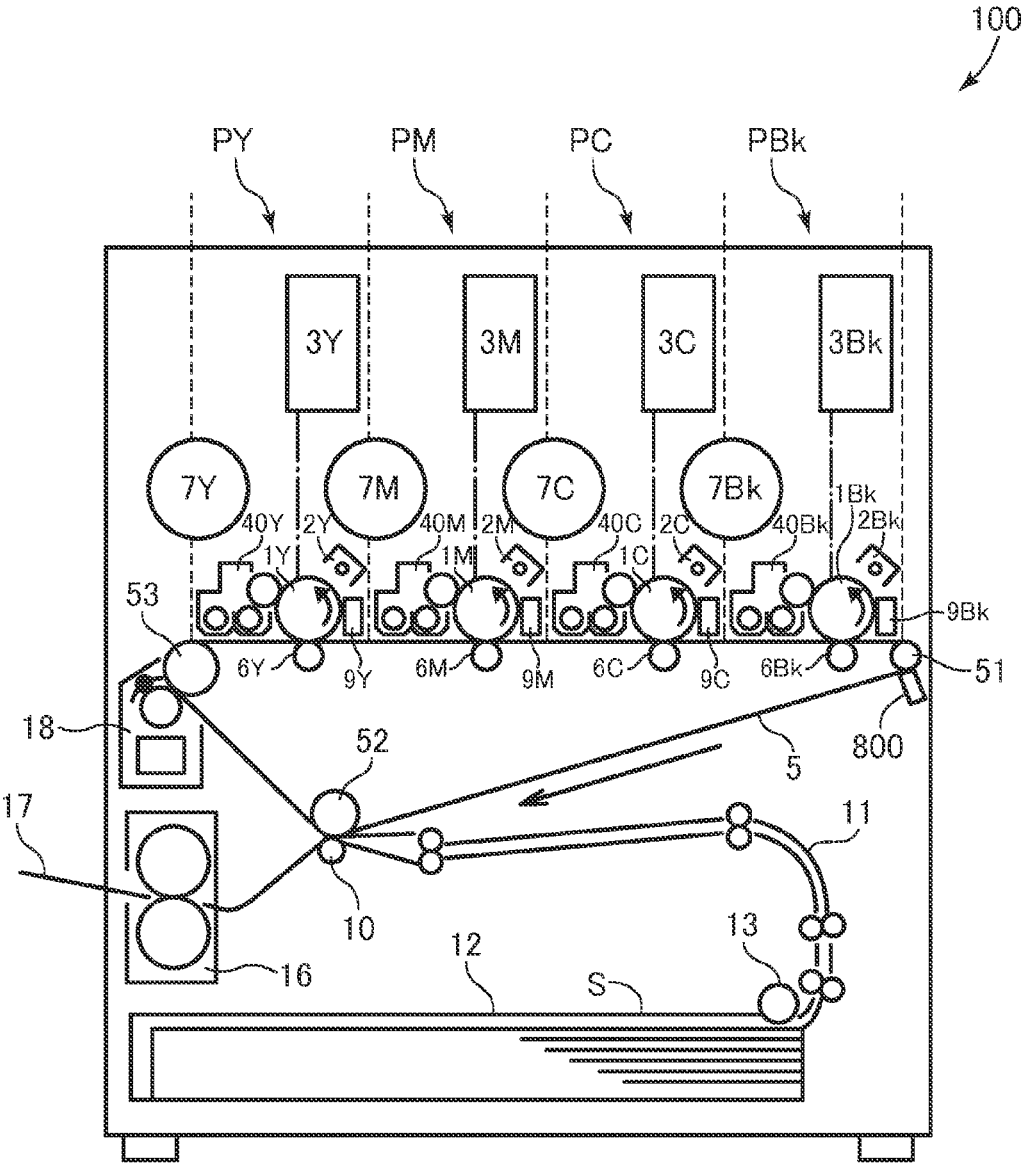
FIG. 1 is a schematic section view illustrating a configuration of an image forming apparatus of an embodiment of the invention.

Embodiments and first and second modified examples of the present invention will be described with reference to FIGS. 1 through 11. Firstly, a schematic structure of a common image forming apparatus will be described with reference to FIG. 1.

[Image Forming Apparatus]

The image forming apparatus 100 of the present embodiment is a full-color image forming apparatus adopting an electro-photographic system. Accordingly, the image forming apparatus 100 includes four image forming portions P (PY, PM, PC, and PBk). The subscripts Y, M, C and Bk denote four colors of yellow (Y), magenta (M), cyan (C), and black (Bk), respectively, which are colors of toner images formed in each of the image forming portions P. Because structures of the respective image forming portions P are the same, the following description will be made by omitting the subscripts Y, M, C and Bk, except in a case when they are required.

The image forming portion P includes a photosensitive drum 1 (1Y, 1M, 1C, and 1Bk), i.e., an image carrier (photosensitive body). The photosensitive drum 1 is a drum-like electro-photosensitive body rotating in a direction of an arrow (counterclockwise) in FIG. 1. The photosensitive drum 1 is provided with image forming mechanisms around thereof per each color. Specifically, provided around the photosensitive drum 1 are a charger 2 (2Y, 2M, 2C, and 2Bk), a developing apparatus 40 (40Y, 40M, 40C, and 40Bk), and a drum cleaner 9 (9Y, 9M, 9C, and 9Bk). The photosensitive drum 1 is also provided with a laser beam scanner 3 (3Y, 3M, 3C, and 3Bk), i.e., an exposure portion, above thereof. Still further, a primary transfer roller 6 (6Y, 6M, 6C, and 6Bk) is disposed per each image forming portion P through an intermediary of an intermediate transfer belt 5, i.e., an intermediate transfer body described later.

Next, an image forming sequence of the entire image forming apparatus constructed as described above will be described. The photosensitive drum 1 rotates with a processing speed (circumferential speed) of 150 mm/sec. in the direction of the arrow (counterclockwise) indicated in FIG. 1. Then, the photosensitive drum 1 is electrified homogeneously by the charger 2. Then, the photosensitive drum 1 homogeneously electrified by the charger 2 is scanned and exposed by the laser beam scanner 3.

The laser beam scanner 3 includes a semiconductor laser. The semiconductor laser is controlled in response to a document image information signal outputted out of a document reading apparatus having a photoelectric converting element such as CCD. Therefore, a laser beam modulated from the image signal is outputted out of the semiconductor laser of the laser beam scanner 3 by controlling the semiconductor laser. Then, surface potential of a part where an image is to be formed of the homogeneously electrified photosensitive drum 1 changes and the changed part becomes an electrostatic latent image. The electrostatic latent image on the photosensitive drum 1 becomes a visible image, i.e., a toner image, when it is developed by toner supplied from the developing apparatus 40.

The developing apparatus 40 of the present embodiment adopts a two-component developing system using a two-component developer having toner and carrier as the developer. The toner image of each of the four colors of yellow, magenta, cyan, and black is formed on the photosensitive drums 1 through the processes described above performed per image forming portion P.

The intermediate transfer belt (intermediate transfer body) 5 of the present embodiment is disposed under the four image forming portions P. The intermediate transfer belt 5 is suspended around a suspension roller 51, a secondary transfer inner roller 52, and a driving roller 53, and is movable in a direction of an arrow indicated in FIG. 1 (clockwise).

The toner images on the photosensitive drums 1 are primarily transferred firstly to the intermediate transfer belt 5 by the primary transfer rollers 6 (6Y, 6M, 6C, and 6Bk), i.e., primary transfer portions. Thereby, the four colors of toner images of yellow, magenta, cyan, and black are superimposed and a full-color image is formed on the intermediate transfer belt 5. The toner left on the photosensitive drum 1 without being transferred is recovered by the drum cleaner 9 of each image forming portion P. The superimposed full-color image is conveyed to a secondary transfer portion facing the secondary transfer inner roller 52.

Meanwhile, a recording medium (sheet member) S such as a sheet of paper and an OHP sheet stacked in the sheet feed cassette 12 is taken out by a feed roller 13. Then, the recording medium S is conveyed through a feed guide 11 to the secondary transfer portion formed of the secondary transfer inner roller 52 and the secondary transfer roller 10 (secondary transfer members). The full-color image on the intermediate transfer belt 5 is transferred to the recording medium S by an action of the secondary transfer roller 10 in the secondary transfer portion. Toner left on a surface of the intermediate transfer belt 5 without being secondarily transferred is recovered by an intermediate transfer belt cleaner 18.

After that, the recording medium S is sent to a fixing apparatus (heat roller fixing apparatus) 16. The fixing apparatus 16 heats and presses the recording medium S to which the toner image has been transferred to fix the image. The recording medium S to which the toner image has been fixed is discharged to a discharge tray 17.

It is noted that while the photosensitive drum 1, i.e., the normally used drum-like organic photosensitive body, is used as an image carrier in the present embodiment, the present invention is not limited to such case. For example, non-organic photosensitive bodies such as an amorphous silicon photosensitive body may be used. It is also possible to use a belt-like photosensitive body. The present invention is not also limited to the systems described above in terms of the charging system, the transfer system, the cleaning system, and the fixing system.

[Developing Apparatus and Developer Replenishing Apparatus]

Next, schematic structures of a developing apparatus 40 and a developer replenishing apparatus 400 configured to replenish the developer to the developing apparatus 40 will be described with reference to FIG. 2. The developing apparatus 40 of the present embodiment includes a developer container 41. The two-component developer containing toner and carrier is stored as the developer in the developer container 41. The developing apparatus 40 also includes a developing sleeve 42 (developer carrier) carrying the developer in the developer container 41 and a regulating blade 43 regulating height of bristles of the developer carried on the developing sleeve 42.

Figure 2:
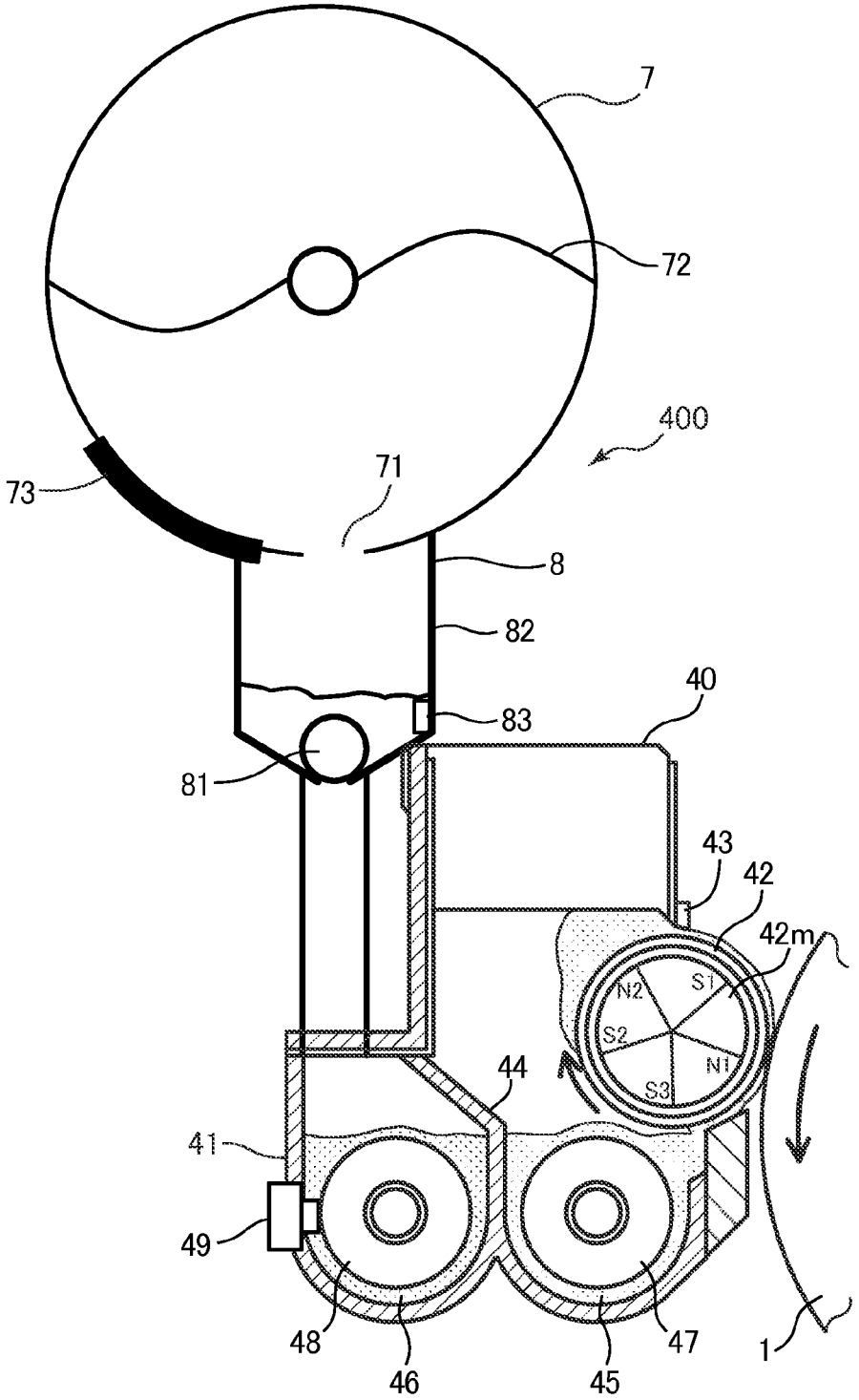
FIG. 2 is a schematic section view illustrating a configuration of a developing apparatus and a developer replenishing apparatus of the embodiment.

An inside of the developer container 41 is partitioned into a developing chamber 45 and an agitating chamber 46 by a partition wall 44 extending substantially through a center part thereof in a direction vertical to a surface of the drawing of FIG. 2. The developer is stored in the developing and agitating chambers 45 and 46 and is circularly conveyed by the following components. That is, conveying screws, i.e., agitating members, for agitating and conveying the developer are disposed respectively in the developing and agitating chambers 45 and 46. Specifically, a first conveying screw (agitating member) 47 is disposed in the developing chamber 45 and a second conveying screw (agitating member) 48 is disposed in the agitating chamber 46. Through conveyance of the developer caused by rotation of the first and second conveying screws 47 and 48, the developer is conveyed in a direction opposite from each other along an axial line and is circulated between the developing and agitating chambers 45 and 46 through openings (communicating portions) located at both ends of the partition wall 44.

A position corresponding to a developing area facing the photosensitive drum 1 of the developer container 41 is opened, and the developing sleeve 42 is exposed out of the opening in a direction of the photosensitive drum 1. In the present embodiment, a diameter (outside diameter) of the developing sleeve 42 is 20 mm and a diameter (outside diameter) of the photosensitive drum 1 is 40 mm. A distance between the developing sleeve 42 and the photosensitive drum 1 in a closest area is set as about 310 μm, and a number of rotations of the developing sleeve 42 in forming an image is set to be 229 rpm (ratio of peripheral speed to the photosensitive drum=160%). It is noted that the developing sleeve 42 and the first and second conveying screws 47 and 48 are rotationally driven in synchronism by a developing motor 40A (see FIGS. 3 and 9), i.e., a driving source.

The developing sleeve 42 carries the two-component developer within the developing chamber 45 while rotating in a direction of an arrow shown in FIG. 2 (clockwise) during development. A layer of the developer (so-called a magnetic brush) is formed on the developing sleeve 42 by an action of a magnet roller 42*m*. A thickness of the magnetic brush is regulated by the regulating blade 43 and the developer whose thickness is regulated is carried on the developing sleeve 42. The developer carried on the developing sleeve 42 in this state is conveyed to the developing area facing the photosensitive drum 1, and the electrostatic latent image on the photosensitive drum 1 is visualized by transferring the toner to the photosensitive drum 1 by an action of a developing bias applied to the developing sleeve 42.

If the toner within the developing apparatus 40 is repeatedly transferred to the photosensitive drum 1 by the process as described above, toner concentration of the developer within the developer container 41 gradually drops, so that the toner is replenished adequately into the developer container 41 to maintain appropriate toner concentration. A toner replenishing structure and a toner replenishing control will be described below with reference to FIGS. 1, 2, 3 and 9.

Provided above the developing apparatus 40 of each color is the developer replenishing apparatus 400 configured to replenish the developer into the developer container 41 corresponding to a toner consumption amount. The developer replenishing apparatus 400 includes a toner container 7 (7Y, 7M, 7C, and 7Bk) and a hopper portion 8. It is noted while the developer replenishing apparatus 400 of the present embodiment is configured to store the toner and to replenish the toner into the developer container 41, the developer replenishing apparatus 400 may be configured to replenish the carrier together with the toner.

The toner container 7 configured to store the toner to be replenished as the developer into the developer container 41 and the toner containers 7 are installed respectively such that they can be attached to/detached from a body of the image forming apparatus 100. The toner container 7 is provided with a discharge port 71 for discharging the toner in the toner container 7 at an under part thereof on a front side of the body of the image forming apparatus (a user operating side) and is configured to discharge the toner by rotating an agitating blade 72. The toner container 7 is configured to prevent the toner from leaking out of the discharge port 71 in taking the toner container 7 out of the body by closing the discharge port 71 by sliding a shutter member 73.

Provided right under the discharge port 71 of the toner container 7 is a hopper portion 8 configured to temporarily store the discharged toner and provided at a lowest part of the hopper portion 8 is a replenishing member 81 configured to convey and replenish the toner to the developing apparatus 40. The replenishing member 81 extends from the hopper portion 8 provided on the body front side in a direction of a body back side and the hopper portion 8 is connected to the agitating chamber 46 so as to replenish the toner to a back side of the agitating chamber 46 of the developing apparatus 40. The replenishing member 81 is a screw member in which a blade of 10 mm in diameter is spirally formed on a shaft of 4 mm in diameter and is rotatably driven by a replenishing motor 81A, i.e., a driving source (see FIGS. 3 and 9). Then, the toner is replenished to the developing apparatus 40 by a rotational motion of the replenishing member 81. Due to that, the replenishing member 81 is configured such that a toner replenishing amount to the developing apparatus 40 varies in response to a rotation time of the replenishing member 81.

The hopper portion 8 is also provided with a piezoelectric sensor 83 detecting a toner residual amount within the hopper portion 8 on a wall surface of a toner storing container 82 of the hopper portion 8 storing the toner. Then, based on a toner presence/absence signal detected by the piezoelectric sensor 83, a CPU (control portion) 101, i.e., an executing portion, described later determines whether or not the toner exists within the toner container 7 and controls the discharge of the toner out of the toner container 7.

The two-component developer used in the present embodiment contains magnetic carrier and non-magnetic toner as its main components. Due to that, if toner concentration of the developer (ratio of weight of the toner to a total weight of the carrier and the toner) changes, the apparent permeability of the developer caused by a mixing ratio of the magnetic carrier and the non-magnetic toner changes. Accordingly, the toner concentration is calculated by detecting the apparent permeability of the developer by an inductance detecting sensor 49, i.e., a concentration detecting portion, provided on the agitating chamber 46 side of the developer container 41. That is, the higher the toner concentration, the higher the ratio of the non-magnetic toner occupied in the developer is, so that the apparent permeability of the developer drops and a detected output (signal) becomes small. In contrary to that, the lower the toner concentration, the higher the apparent permeability of the developer is, so that the detected output increases. Thus, it is possible to detect the toner concentration of the developer within the developer container 41 by using the inductance detecting sensor 49.

Figure 9:
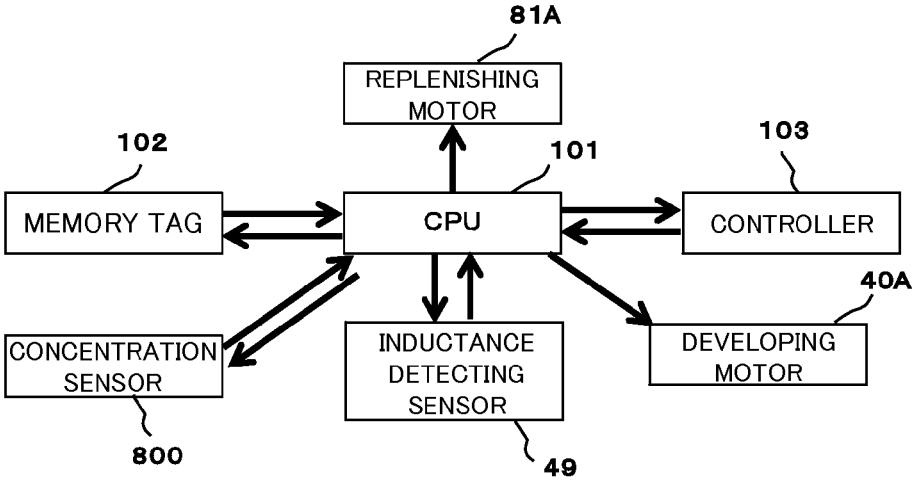
FIG. 9 is a control block diagram in replenishing developer according to the embodiment of the present invention.

As shown in FIG. 9, the signal (Vsig) detected by the inductance detecting sensor 49 is recorded in advance in a memory tag 102 attached to the developing apparatus 40 and is compared with an initial reference signal Vref read in the CPU 101. Then, the CPU 101 calculates a difference of both signals (Vsig−Vref) and based on the calculation result, calculates a toner replenishing amount and controls the replenishing motor 81A. The initial reference signal Vref is an output value corresponding to an initial state of the developer, i.e., initial toner concentration, so that the control is made such that Vsig approaches to the initial reference signal Vref.

For instance, in a case when Vsig−Vref>0, the toner concentration of the developer is lower than target toner concentration, so that the control portion 101 determines a required toner replenishing amount corresponding to a degree of the difference, i.e., the rotation time of the replenishing member 81. Due to that, the larger the difference between Vsig and Vref, the more the toner is replenished. Here, the more the toner consumption amount, the greater the difference between Vsig and Vref becomes, so that the toner of a quantity corresponding to the toner consumption is replenished into the developer container 41. In a case when Vsig−Vref≤0, the toner concentration is higher than the target toner concentration, so that the control portion 101 stops the rotation of the replenishing member 81 to lower the toner concentration by the toner consumed in an image forming operation. The toner replenishing control is made as described above.

[Forcible Replenishing Mode]

Figure 4:
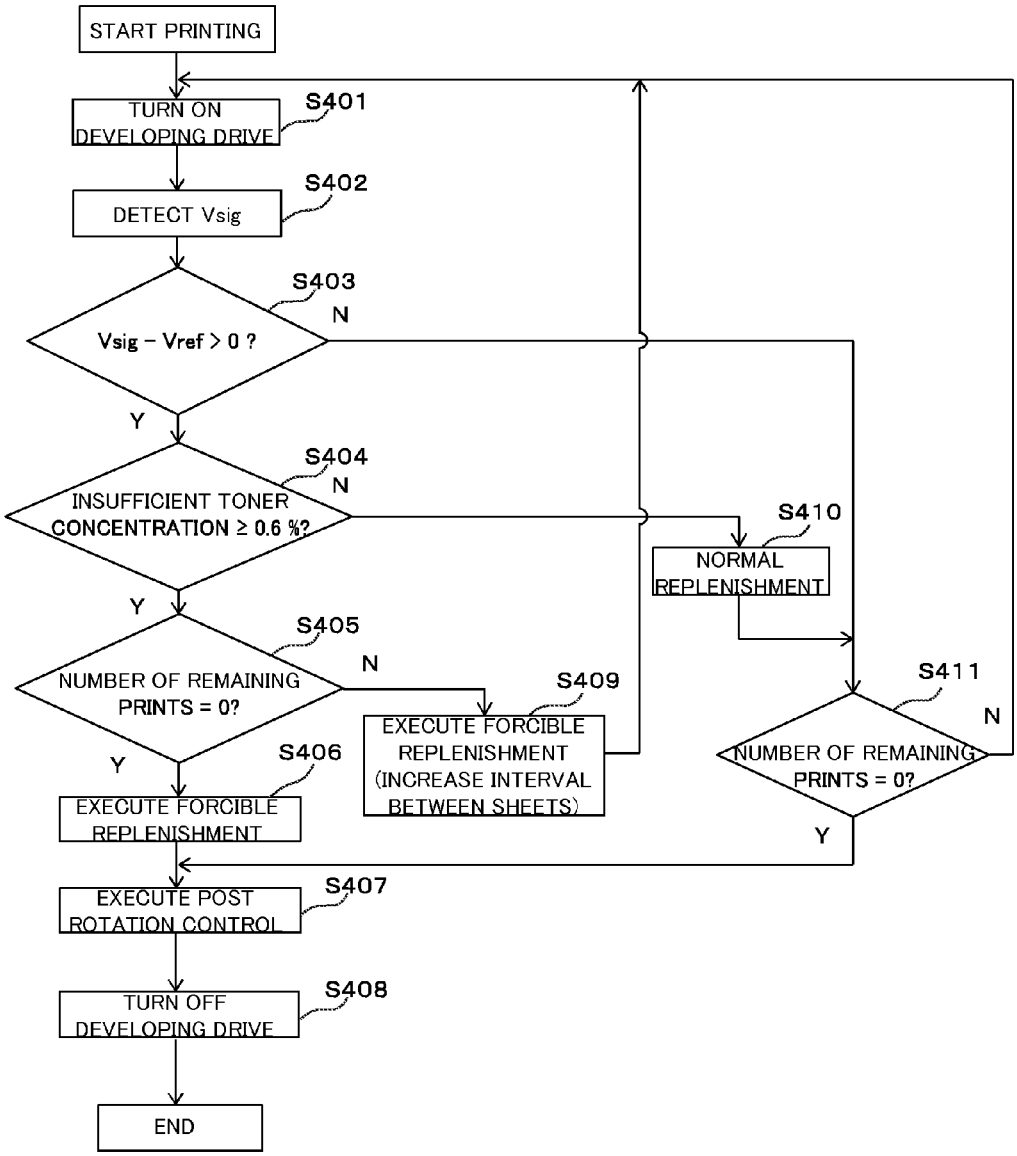
FIG. 4 is a control flowchart in conducting forcible replenishment according to the first modified example.

Next, a forcible replenishing mode of the present embodiment will be described with reference to FIGS. 9 and 4. In a case when images having a high image ratio in particular are consecutively printed, a toner quantity to be replenished to the developing apparatus 40 remarkably increases, so that a toner quantity to be conveyed and replenished by the replenishing member increases. However, there is a case when a required toner quantity cannot be replenished depending on a configuration of the replenishing member 81. For instance, the replenishing member 81 cannot but be downsized if an image forming apparatus is downsized and a space therein is limited in particular. Because toner conveying performance is liable to be dropped if the replenishing member 81 is downsized, there is a case when the toner replenishing amount cannot be kept up with the toner consumption amount in the case when the images with the high image ratio are consecutively printed in particular. Then, a forcible replenishing mode of replenishing insufficient toner during a period of a non-image area such as a post-rotation time and intervals between sheets is performed in such a case in the present embodiment.

The developing apparatus 40 is started to be driven (turned ON) in Step S401 in response to development starting timing after when a printing (image forming) operation is started. Then, the control portion 101 detects Vsig by the inductance detecting sensor 49 in Step S402. The control portion 101 compares Vsig with Vref recorded in the memory tag 102 in Step S403. While the control portion 101 executes no replenishing operation in a case when Vsig−Vref≤0, the control portion 101 executes the replenishing operation in a case when Vsig−Vref>0.

In a case when the toner replenishing amount does not keep up with the toner consumption amount at this time, a deviation between Vsig of the inductance detecting sensor 49 and Vref which is the target value of the toner concentration increases. In the present embodiment, the control portion 101 executes the forcible replenishing mode when it detects that the required toner replenishing amount calculated from Vsig−Vref is equivalent to or more than 0.6% in terms of the toner concentration in Step S404. In a case when a situation is not applicable to that described above, the control portion 101 executes a normal toner replenishing operation in Step S410. In a case when a number of remaining prints in the printing job is zero, i.e., Yes in Step S411, the control portion 101 shifts the process to Step S407 described below. In a case when the number of the remaining prints of the printing job is not zero, i.e., No in Step S411, the control portion 101 returns the process to Step S401.

In a case when the number of the remaining prints of the printing job is zero, i.e., Yes in Step S405, the control portion 101 shifts the process to the forcible replenishing mode in Step S406. In this case, the control portion 101 starts a post-rotating operation and rotates the replenishing member 81 to replenish a required quantity of toner to fulfill the initially insufficient quantity of toner concentration (0.6% here). Along with that, the control portion 101 drives the developing sleeve 42, the first and second conveying screws 47 and 48 by a predetermined period of time to agitate the replenished toner in Step S407. After that, the control portion 101 stops to drive the developing apparatus 40 in Step S408.

Still further, if the number of the remaining prints of the printing job is not zero, i.e., No in Step S405, the control portion 101 interrupts the printing job once, widens intervals between sheets and replenishes the required quantity of toner during that. Along with that, the control portion 101 drives the developing sleeve 42 and the first and second conveying screws 47 and 48 for a predetermined period of time to agitate the replenished toner in Step S409. Then, the control portion 101 returns the process to Step S401.

It is possible to control the toner concentration into a predetermined range even if the image forming apparatus is downsized and the replenishing member with low toner conveying performance is used by executing the forcible replenishing mode as described above. It is noted that while the process is shifted to the forcible replenishing mode in the configuration of the present embodiment in a case when images whose image ratio is 80% or more are consecutively printed, this value varies depending on the developing apparatus to be used and on the configuration of the replenishing member. In the present embodiment, the CPU 101 uses the output value of the inductance detecting sensor 49 in order to determine whether or not the process should be shifted to the forcible replenishing mode. However, beside the output value described above, it is also possible to use an output value of an optical toner concentration detecting sensor, an output value of an optical image concentration sensor configured to detect concentration of a controlling toner image (patch image) and others depending on a configuration of the image forming apparatus.

[Controlling Toner Image Forming Mode]

A control using the controlling toner image (patch image) is made in the present embodiment to correct a target value of the inductance detecting sensor 49. To that end, the image forming apparatus 100 is provided with a concentration sensor 800 detecting concentration (toner carrying amount) of a reference toner image downstream of the image forming portions P of the intermediate transfer belt 5 as shown in FIG. 1. In the present embodiment, the concentration sensor 800 is disposed at a position facing the suspension roller 51 of the intermediate transfer belt 5 and sequentially detects the concentration of the reference toner image of each color transferred to the intermediate transfer belt 5 at this position. The concentration sensor 800 is an optical reflecting type sensor. Then, the CPU 101 calculates the concentration (toner carrying amount) of the toner on the intermediate transfer belt 5 from a difference of a reflected light quantity of the intermediate transfer belt 5 in an area where no toner is carried and a reflected light quantity of the intermediate transfer belt 5 where the toner is carried detected by the concentration sensor 800.

In such control, a patch image for controlling a quantity of developer to be replenished to the developer container 41 is formed in the non-image area such as an area between sheets where no image to be transferred to a recording medium is formed. In other words, the image forming operation is interrupted during the consecutive image forming job to form the patch image. Here, the consecutive image forming job is a period from a start to a completion of an image forming operation performed based on printing signals for consecutively forming images on a plurality of recording media. Specifically, the printing job refers to a period from a prerotation time (preparatory operation before forming images) after receiving the printing signal to a post-rotation time (operation after forming images) and to a period including an image forming period and intervals between sheets (non-image forming time). It is noted that if another job is entered continuously after one job, these jobs will be judged to be one job collectively.

An output corresponding to the concentration of each color of the patch image conveyed by the intermediate transfer belt 5 is detected at the portion facing the concentration sensor 800 and is compared with a reference concentration stored in the memory tag 102. Then, when it is detected that the detected concentration is lower than the reference concentration, the target value is corrected so as to increase the target toner concentration of the inductance detecting sensor 49. In contrary, when it is detected that the detected concentration is higher than the reference concentration, the target value is corrected so as to lower the target toner concentration of the inductance detecting sensor 49.

Thus, the control is made to keep the concentration of the patch image within a predetermined range by correcting the target value of the inductance detecting sensor 49 based on the detected result of the patch image. As a result, a toner electrification amount within the developing apparatus can be made substantially constant, so that it is advantageous in terms of stability of hue.

Because the patch image is formed in the non-image area as described above, an inter-sheet time is used as timing for forming the patch image beside the post-rotation time. However, a time for forming, detecting and cleaning the patch image is not enough in the normal inter-sheet time, an interval between sheets at forming the patch image is widened more than that of the normal inter-sheets (the printing job is interrupted once). The patch image is normally formed at certain degree of intervals because productivity is lowered if the inter-sheet space is widened more than the normal inter-sheet space.

FIRST MODIFIED EXAMPLE

Here, a first modified example will be described.

[Idling Mode]

Firstly, an idling mode will be described. If the toner container 7 is left in a high-temperature and high-humid environment for a long period of time for example as described above, there is a case when the toner within the container 7 clumps together and forms agglomerates. If such agglomerates are replenished into the developer container 41 as they are, there is a possibility of generating smears in an image. Due to that, an idling operation as described below is performed in the reference example to crush such agglomerates within the developer container 41 in the case where there is such possibility. It is noted that because the smears of the image caused by the toner agglomerates occur even when images whose image ratio is lower than the image ratio by which the process is shifted to the forcible replenishing mode described above are printed consecutively, it is necessary to perform the idling mode described below beside the forcible replenishing mode.

That is, the CPU 101 executes the idling mode of driving the first and second conveying screws 47 and 48, i.e., the agitating members, without forming the patch image as described above in the non-image area in a case when a value related to the toner replenishing amount exceeds a predetermined threshold value. In other words, in a case when the toner replenishing amount per unit sheet is large, the CPU 101 performs the control of idling the developing apparatus only for a predetermined period of time in the non-image area. Here, the CPU 101 executes the idling mode when the value described below and related to the toner replenishing amount exceeds the predetermined threshold value. Still further, no toner is substantially replenished by the developer replenishing apparatus 400 in the idling mode. The case of replenishing substantially no toner includes not only the case of replenishing totally no toner in executing the idling mode but also a case when toner is replenished to a degree not affecting density of an image. Specifically, the latter case applies not to a replenishing operation controlled to maintain the toner concentration, but to a case replenished due to inertia when the replenishing member is stopped and to a case when a small amount toner is replenished by fall of toner due to vibrations.

Still further, the CPU 101 is configured to increase the number of rotations of the first and second conveying screws 47 and 48 in the non-image area in the case when the value related to the toner replenishing amount is greater that the predetermined threshold value more than the case when the value is less than the predetermined threshold value in the idling mode. In the modified example, the CPU 101 executes the idling mode (by interrupting the image forming operation) just before shifting to the post-rotating operation or by widening the interval between sheets (by interrupting the image forming operation once). That is, the CPU 101 executes the idling mode by prolonging the respective rotating times more than those in the idling mode of the normal post-rotating operation and the inter-sheet space in which the value related to the toner replenishing amount is less than the predetermined threshold value. The numbers of rotations of the first and second conveying screws 47 and 48 increases during the time in which no image is formed more than those of the normal post-rotating operation and the inter-sheet space by prolonging the times as described above.

It is noted that the inter-sheet period (inter-image period, period between images) refers to a period until when a succeeding formed electrostatic latent image is developed by the developing apparatus 40 after when a preceding electrostatic latent image is developed by the developing apparatus 40 in the modified example.

Still further, an average image ratio which is an image ratio per sheet of a predetermined number of image forming sheets (number of image forming sheets) is used as the value related to the toner replenishing amount in the modified example. This average image ratio is calculated by using moving average values of image ratio of 100 sheets on which images are formed most recently (the predetermined number of image forming sheets) in the modified example. The non-image area is an area which no normal image forming operation is carried out, i.e., no image forming operation is carried out based on image information inputted by a user from a scanner, a personal computer or the like. Specifically, the non-image area is an area between normal images consecutively formed (an interval between consecutive images or an inter-sheet space) or a area of post-rotating operation in which the photosensitive drum 1 and the developing apparatus 40 are driven along with an end of an image forming operation. In other words, it is an area which no image to be transferred to a recording medium is formed.

Here, the CPU 101 counts (integrates) the value (here, the number of image forming sheets) related to the number of image forming sheets as a first detecting portion and stores in the memory tag 102, i.e., a storage portion. Still further, the controller 103 which processes an image information signal of an inputted image (an image to be formed) inputs a value (here a video count value) corresponding to the image information signal to the CPU 101 which is also a second detecting portion. The CPU 101 counts (integrates) the video count value and stores it to the memory tag 102. Then, the CPU 101 calculates the average image ratio of the most recent predetermined number of image forming sheets (100 sheets) from an integrated number of image forming sheets (value of a first counter) and an integrated video count value (integrated value, value of a second counter) stored in the memory tag 102. It is noted that the CPU 101 becomes a detecting portion detecting the value related to the toner replenishing amount in the modified example.

In a case when the average image ratio thus calculated exceeds a predetermined image ratio, i.e., the predetermined threshold value which is 30% or more for example, the CPU 101 executes the idling mode in the non-image area. In the modified example, the developing sleeve 42 is also driven in addition to the first and second conveying screws 47 and 48 in the idling mode. Because these are driven in synchronism with the developing motor 40A, they are driven simultaneously also in the idling mode. Accordingly, the CPU 101 executes the idling mode by controlling the developing motor 40A. It is noted that in the modified example, the drive of the photosensitive drum 1, the application of the electrification bias by the charger 2, and the application of the developing bias are not stopped.

However, it is enough if the first and second conveying screws 47 and 48 are driven at least in the idling mode in order to crush the agglomerates and others may be stopped as necessary. However, the developer is agitated further and the agglomerates are more liable to be crushed by driving also the developing sleeve 42.

One example of such control will be described below with reference to FIG. 5. The developing apparatus 40 is started to be driven (turned ON) in Step S1 in response to development starting timing after when a printing (image forming) operation is started. Next, the video count value corresponding to an image to be printed is inputted from the controller 103 to the CPU 101 in Step S2. Still further, an integrated number of printed sheets (cumulative number of prints) stored in the memory tag 102 and the integrated video count value (cumulative video count value) are read into the CPU 101 per each color in Steps S3 and S4, and the CPU 101 calculates an average image ratio per one image per every each color in Step S5.

The toner concentration of the developer within the developer container 41 is calculated based on the detected output of the inductance detecting sensor 49 during the developing operation. If the toner concentration is lower than a target value, the CPU 101 calculates a required toner replenishing amount and drives the replenishing member 81 to replenish the toner into the developer container 41.

When the printing operation is executed and a number of remaining prints of the printing job is zeroed, i.e., Yes in Step S6, the CPU 101 determines whether or not average image ratio at that time is greater than a predetermined image ratio (30%) per every each color in Step S7 before shifting to the post-rotating operation. Then, in a case when the average image ratio of either color is greater than the predetermined image ratio, i.e., Yes in Step S7, the CPU 101 executes the idling mode of the developing apparatus 40 in which the average image ratio is greater than the predetermined image ratio in Step S8 before entering the post-rotating operation. In the modified example, the CPU 101 controls such that the idling mode is executed only in the specific developing apparatus in which the average image ratio is greater than the predetermined image ratio and such that the other developing apparatuses are stopped. It is noted that in a case when the average image ratio of every color is less than the predetermined image ratio, i.e., No in Step S7, the CPU 101 shifts the process to the normal post-rotating operation in Step S10.

In the present modified example, the developer replenishing apparatus 400 is stopped to replenish the developer so that no toner is replenished into the developer container 41 during the execution of the idling mode of the developing apparatus. Thereby, even if toner agglomerates are contained within the toner container 7, the idling mode can be executed in a state in which no agglomerate newly enters the developer container 41. Accordingly, it is possible to steadily crush the agglomerates by the agitating operation within the developer container 41. Still further, the idling mode is executed for a predetermined period of time (here, 4.2 sec.) in the modified example. After finishing the idling mode, the integrated number of printed sheets within the memory tag 102 and the integrated video count value, i.e., the values related to the toner replenishing amount, are reset to zero in Step S9, and the CPU 101 shifts the process to the normal post-rotating operation in Step S10. After finishing the post-rotating operation, the CPU 101 turns OFF the developing drive in Step S11 and stops the operations of the body to finish the series of jobs.

Figure 5:
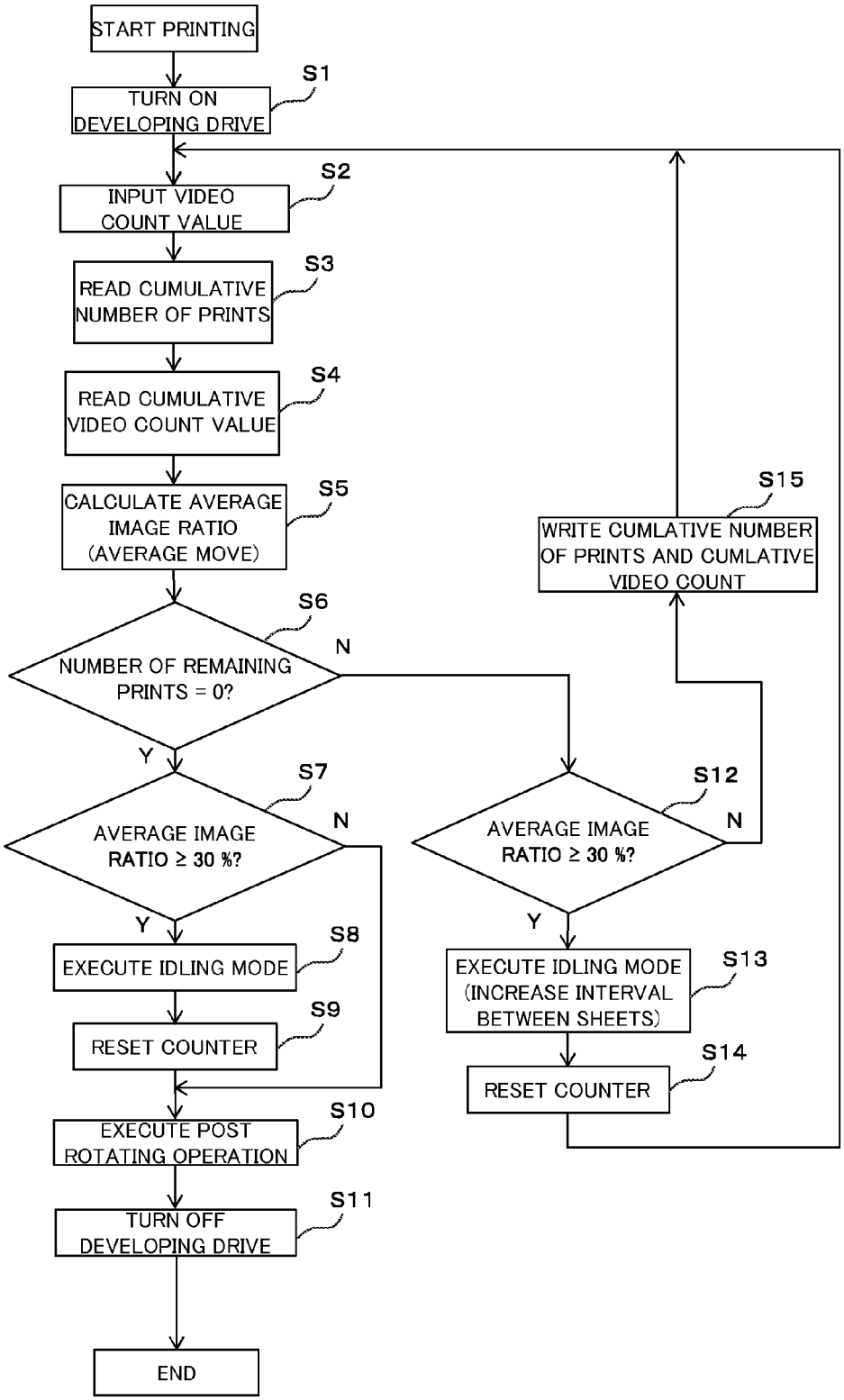
FIG. 5 is a control flowchart in conducting an idling mode according to the first modified example.

The CPU 101 determines whether or not the average image ratio at the moment is greater than the predetermined image ratio (30%) per every color in Step S12 similarly to Step S7 also when a number of remaining prints of the job is not zero, i.e., No in Step S6 in FIG. 5. Then, if the average image ratio of either color is greater than the predetermined image ratio, i.e., Yes in Step S12, the CPU 101 widens an inter-sheet space, i.e., a space with a next image, more than normal one to execute the idling mode in Step S13. The integrated number of printed sheets within the memory tag 102 and the integrated video count value of the color of which the average image ratio is greater than the predetermined image ratio are reset to zero in Step S14, the CPU 101 shifts the process to the next image forming operation (returns to Step S2). Meanwhile, in a case when the average image ratio of every color is less than the predetermined image ratio, i.e., No in Step S12, the integrated number of printed sheets and the integrated video count value at the moment are written into the memory tag 102 in Step S15 and the next image forming operation is performed with the normal inter-sheet length (returns to Step S2).

The present modified example enables to suppress imaging failure caused by the agglomerates in the case in which the average image ratio is greater than the predetermined image ratio, i.e., even if the toner replenishing amount per unit sheet is large. That is, the idling mode increasing the numbers of rotations driving the first and second conveying screws 47 and 48 is executed in the non-image area (in the inter-sheet space and during the post-rotating operation in the present modified example) in the case when the average image ratio is greater than the predetermined image ratio more than that in the case in which the average image ratio is less than the predetermined image ratio. Therefore, it is possible to crush the agglomerates more contained in the developer replenished to the developer container during that. Specifically, the numbers of rotations of the first and second conveying screws 47 and 48 in the non-image area is increased by prolonging the respective rotating times more than those of the normal post-rotating operation and the inter-sheet space in the idling mode. Therefore, it is possible to crush more agglomerates than the case in the normal non-image area and to suppress imaging failure otherwise caused by the agglomerates.

In particular, even if the toner container 7 containing a large number of toner agglomerates by being stored in a high-temperature and high-humidity environment for a long period of time is attached and even if images having high image ratio are consecutively printed, it is possible to effectively crush the agglomerates within the developer container. Accordingly, it becomes possible to prevent smear of images otherwise caused by the toner agglomerates reaching to the developing sleeve as they are and to provide the image forming apparatus enabling to stably obtain high quality images.

Figure 6:
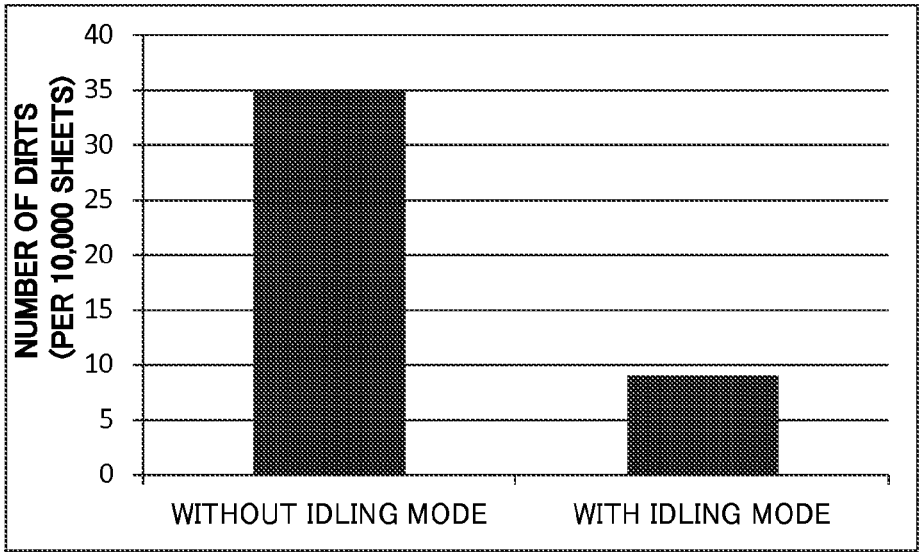
FIG. 6 is a graph illustrating results of experiments performed to confirm effects of the first modified example.

Next, experiments carried out to confirm the advantageous effect of the present modified example will be described. The experiments were carried out to study a number of smeared images generated when images with 45% of image ratio are consecutively printed by 10,000 sheets respectively in the case when the idling mode of the modified example is executed and a case when no idling mode is executed. The toner container left in a high-temperature and high-humidity environment, e.g., temperature of 40° C. and relative humidity of 80%, and contain a large number of agglomerates was used. FIG. 6 shows results of the experiments. A bar chart on a left side of the graph indicates the case when no idling mode was executed (no idling mode) and a bar chart on a right side of the graph indicates the case when the idling mode of the present modified example was executed (with the idling mode), respectively.

As it is apparent from FIG. 6, the number of smeared images could be reduced to about 26% of an original number (rate of reduction: 74%) even when images with the high image ratio (here, 45%) are consecutively printed by executing the idling mode of the present modified example. Thus, it is possible to considerably reduce the smeared images even when the images with the high image ratio are consecutively printed.

It is noted that in the present modified example, the predetermined threshold value (the predetermined image ratio) in performing the idling mode was set such that the average image ratio is 30% or more and the time of the idling mode is 4.2 sec. However, those values are not limited to those numerical values and are desirable to be set at adequate values in accordance to a configuration of the developing apparatus to be used, to a type of the developer to be used, and the like.

Still further, the time of the idling mode was set by executing the idling mode before the post-rotating operation or by widening the inter-sheet space to increase the numbers of rotations of the first and second conveying screws 47 and 48 in the present modified example. However, the idling mode may be arranged such that the numbers of rotations of the first and second conveying screws 47 and 48 are increased by increasing driving speeds of at least the first and second conveying screws 47 and 48. In this case, the time used only for the idling mode may be eliminated or shortened.

Still further, the average image ratio calculated from the integrated number of printed sheets is used as the value related to the toner replenishing amount in the present modified example. However, the average image ratio may be calculated by using an integrated number of rotations of the developing sleeve 42 as the value related to the toner replenishing amount. In this case, it is also possible to calculate an image ratio in which a time during which the developing device is driven for the control operation and others other than the image forming operation is taken into account. Still further, while the average image ratio is used as a trigger for executing the idling mode, an integrated Duty value may be used as described later in an embodiment of the invention.

SECOND MODIFIED EXAMPLE

Figure 3:
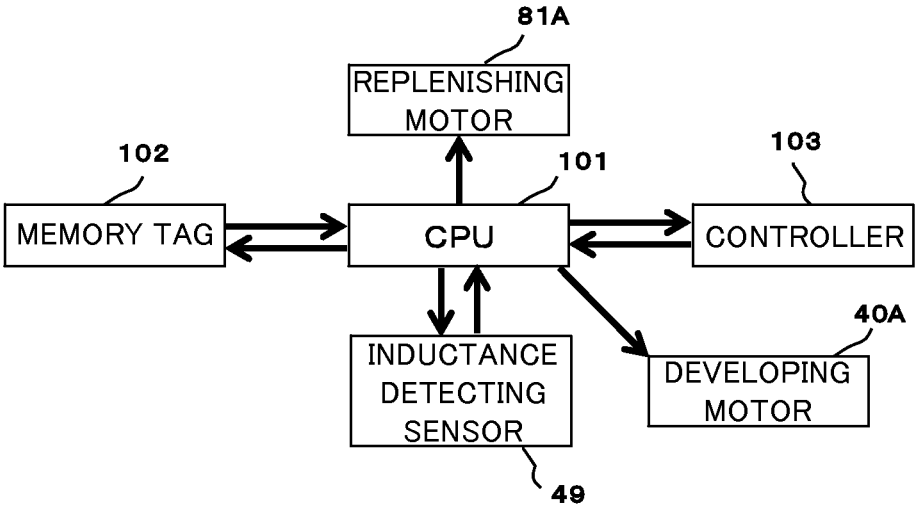
FIG. 3 is a control block diagram in replenishing developer according to a first modified example.
Figure 7:
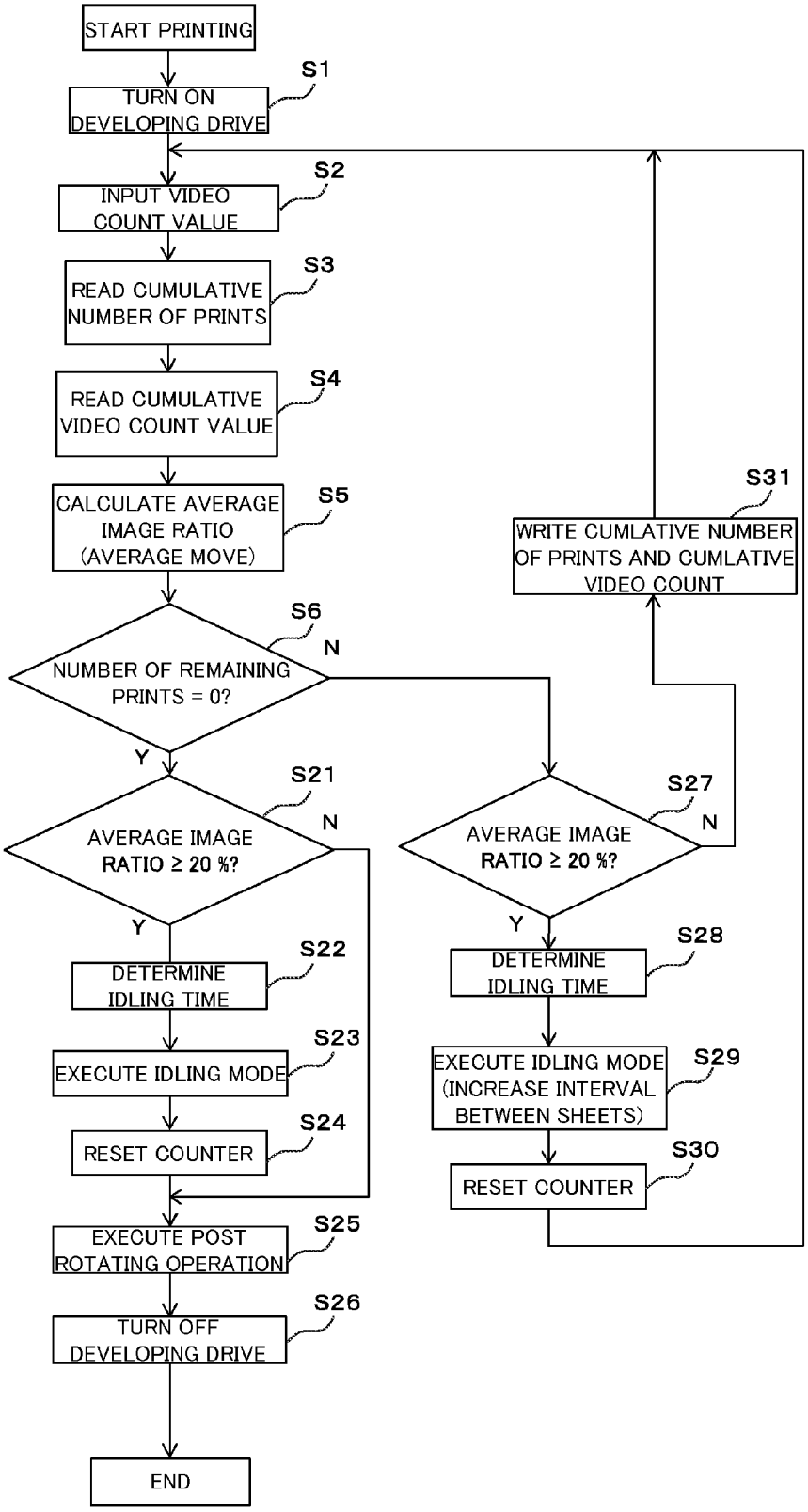
FIG. 7 is a control flowchart in conducting an idling mode according to a second modified example.

A second modified example of the present invention will be described with reference to FIGS. 1 through 3 and by using FIGS. 7 and 8. The time of the idling mode was made constant in the first modified example described above. However, in the present modified example, a driving time of the first and second conveying screws 47 and 48 and others is varied in the idling mode corresponding to the value (the average image ratio in the present modified example) related to the toner replenishing amount. The other components and actions are the same with the first modified example described above, so that the following description will be made centering on points different from the first modified example.

In the case of the present modified example, the higher the average image ratio, the longer the CPU 101 prolongs the driving time (idling time) of the first and second conveying screws 47 and 48 and others in the idling mode. One such exemplary control will be described with reference to FIG. 7. The processes from the start of printing to Step S6 are the same with those of the first modified example shown in FIG. 5. That is, the average image ratio is calculated by the moving average values in prints of the most recent 100 sheets from the integrated number of printed sheets and the integrated video count value also in the present modified example.

Then, the idling mode has been carried out for a certain period of time if the calculated average image ratio is 30% or more in the first modified example. However, the present modified example is modified such that the time of the idling mode to be executed is varied in response to the average image ratio in a case when the average image ratio is 20% or more as the predetermined image ratio. That is, while the idling mode is carried out when the average image ratio is 20% or more, i.e., Yes in Steps 21 and 27, the idling time at that time is determined from the following Table 1:

TABLE 1

| SEGMENTS OF IMAGE RATIO | IDLING TIME |
|---|---|
| D ≤ 20% | 0 sec |
| 20% < D ≤ 60% | 0~2.1 sec |
| 60% < D ≤ 80% | 2.1~4.5 sec |
| 80% < D ≤ 100% | 4.5~8.4 sec |

Figure 8:
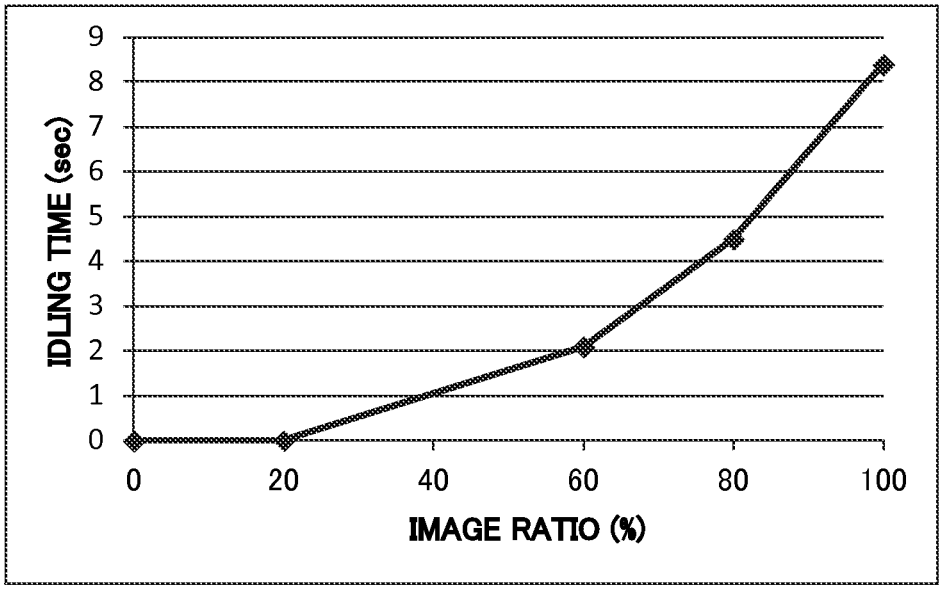
FIG. 8 is a graph illustrating a relationship between an average image ratio and an idling time according to the second modified example.

FIG. 8 is a graph representing Table 1. The idling time is determined by linear interpolation during one image ratio segment. As it can be seen from FIG. 8, the control is made such the higher the average image ratio, the longer the idling time is. That is, the CPU 101 determines the idling time in Steps S22 and S28 corresponding to the average image ratio from Table 1 and FIG. 8. This table is stored in the memory tag 102 in advance. The CPU 101 executes the idling mode for the determined idling time in Steps 23 and S29. It is noted that the processes from Step S23 to Step S26 in FIG. 7 is the same with Step S8 to Step S11 in FIG. 5, Step S29 to Step S31 in FIG. 7, and Step S13 to Step S15 in FIG. 5, respectively.

The modified example as described above makes it possible to effectively reduce the number of agglomerates without causing useless downtime by performing the idling mode adequately conforming to the average image ratio. It is also possible to steadily suppress the occurrence of smeared images caused by the agglomerates even if images with high image ratio are printed consecutively in particular.

That is, because the toner quantity replenished per unit sheet increases remarkably if the average image ratio is specially high, a number of agglomerates entering the developer container 41 increases if the toner container 7 contains a large number of agglomerates. In such a case, there is a possibility that the action of crushing the agglomerates by the agitation becomes insufficient if the idling time of the developing device is short. Therefore, it is effective to prolong the idling time like the present modified example.

In contrary to that, if the image ratio is in an intermediate level, e.g., 20% to 60%, an idling time conforming to a higher image ratio, e.g., 80% to 100%, is excessively long if it is set as the idling time. As a result, a downtime for the idling mode is uselessly generated. Then, it is effective to select an idling time conforming to an image ratio.

The case when the idling time (driving time of the first and second conveying screws 47 and 48 and others) is varied corresponding to the average image ratio has been described in the above explanation. However, it is possible to arrange so as to vary the driving speed of the first and second conveying screws 47 and 48 without varying the idling time. In such a case, the action of agitating and crushing the agglomerates increases even if the driving speed is changed. Still further, it is also possible to combine with the forcible replenishing mode in the present modified example similarly to the first modified example.

<Embodiment of the Present Invention>

An embodiment of the present invention will be described with reference to FIGS. 1 and 2 and by using FIGS. 9 through 11. In the present embodiment, the control method of detecting concentration of a patch image formed in a non-image area and using the detected result is adopted as a toner concentration controlling method of the developer within the developer container 40. That is, the toner replenishing control based on the detected result of the inductance detecting sensor 49 disposed in the developer container 40 is made also in the present embodiment similarly to the first and second modified examples. Still further, in addition to that, the control using the patch image is made to correct a target value of the inductance detecting sensor 49 similarly to the first modified example.

Still further, a control of interrupting an image forming operation during a consecutive image forming job when a number of image forming sheets reaches to a predetermined number of sheets (case A) and when an integrated Duty value obtained by integrating the image ratios reaches to a predetermined value (case B) to form a controlling patch and to adjust the toner concentration within the developer container (controlling image forming mode) is made in the present embodiment. Then, because a risk of causing the agglomerates is higher in the case B than the case A, the present embodiment is arranged such that the number of rotations driving the first and second conveying screws 47 and 48 increase in interrupting the image forming operation in the controlling image forming mode. However, it is possible to arrange such that the developer is replenished in interrupting the image forming operation (including the time of the idling mode described later) in the case of the present embodiment.

Still further, in the case of the present embodiment, the CPU 101 as the second detecting portion detecting the value related to the toner replenishing amount calculates an integrated value obtained by integrating values corresponding to image information signals. The CPU 101 which is also the first detecting portion detecting a value related to the number of image forming sheets integrates the number of image forming sheets. Then, the CPU 101, i.e., the executing portion, is capable of executing the following first and second modes.

The first mode is a mode of forming a patch image during an interruption of the image forming operation (the non-image area) in a case when an integrated value of the number of image forming sheets becomes more than a first threshold value before when an integrated value of values corresponding to the image information signals reaches a second threshold value. The second mode is a mode of forming the patch image during the interruption of the image forming operation in a case when the integrated value of the values corresponding to the image information signal becomes more than the second threshold value before when the integrated value of the number of image forming sheets reaches the first threshold value. The present embodiment is configured such that the number of rotations driving the first and second conveying screws 47 and 48 in the non-image area is increased in the second mode more than that in the first mode.

That is, in the second mode, the idling mode of driving the first and second conveying screws 47 and 48 without forming any patch image is executed in addition to the formation of the patch image. The first mode is the same with the controlling image forming mode described in the first modified example. Accordingly, the number of rotations of driving the first and second conveying screws 47 and 48 during the interruption of the image forming operation increases in the second mode than that in the first mode because the idling mode is executed. From above, a control using the integrated number of printed sheets (number of image forming sheets) and an integrated video count value (the integrated value, an integrated Duty value in the present embodiment) as triggers executing the formation of the patch image and the idling mode is made in the present embodiment.

That is, the CPU 101 counts the integrated number of printed sheets (value of a first counter) and the integrated Duty value (value of a second counter) and stores the values in the memory tag 102 also in the present embodiment. Here, the integrated Duty value is that equivalent to the integrated video count value and is what the video count value is converted into an image ratio per sheet of an A4 size document. That is, in a case when a whole face of the A4 size sheet is a solid document, the Duty value is 100%.

Then, in a case when the integrated Duty value becomes more than the second threshold value before when the integrated number of printed sheets becomes the first threshold value, the CPU 101 forms the patch image and executes the idling mode (second mode) during the interruption of the image forming operation. Meanwhile, in a case when the integrated number of printed sheets becomes more than the first threshold value before when the integrated Duty value becomes the second threshold value, the CPU 101 forms the patch image without executing the idling mode during the interruption of the image forming operation (first mode). In the case of the present embodiment, the first threshold value is set at 60 sheets and the second threshold value is set at 600%.

Figure 10A:
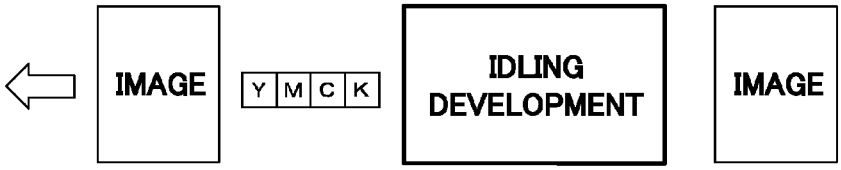
FIG. 10A is a schematic diagram illustrating a state in which a reference toner image is formed between sheets in executing the idling mode.
Figure 10B:
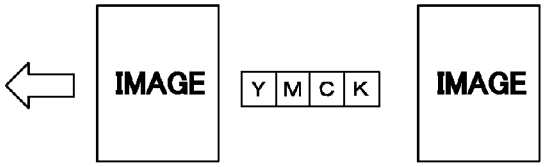
FIG. 10B is a schematic diagram illustrating a state in which a reference toner image is formed between sheets in a case when no idling mode is executed.

FIGS. 10A and 10B show cases when the patch image is formed between sheets. The patch image formed in the image forming portion of each color is transferred to a widthwise (the orthogonal direction of rotatary direction) center part of the intermediate transfer belt 5 in order of YMCK. It is because the concentration sensor 800 is installed at the corresponding position. Horizontal and vertical sizes of the patch image are both 20 mm and reference concentration of the patch image is set at 0.8, where maximum concentration is 1.6 (i.e., a half-tone image).

Here, the CPU 101 executes the idling mode after forming the patch image as shown in FIG. 10A in the second mode in which the idling mode is executed in a timing of forming patch image during the interruption of the image forming operation. That is, in the case when the integrated Duty value becomes more than the second threshold value before when the integrated number of printed sheets becomes the first threshold value, the CPU 101 executes the idling mode of driving the first and second conveying screws 47 and 48 as it is between the sheets in succession after forming the patch image. Meanwhile, in the case of the first mode in which the integrated number of printed sheets becomes more than the first threshold value before when the integrated Duty value becomes the second threshold value, the CPU 101 forms only the patch image between the sheets and does not execute the idling mode as shown in FIG. 10B.

The image forming apparatus 100 also includes a resetting portion configured to reset the integrated value when the second mode is executed. The CPU 101 functions as the resetting portion in the present embodiment.

One example of such control will be described with reference to FIG. 11. The developing apparatus 40 is started to be driven (turned ON) in Step S101 in response to development starting timing after when a printing (image forming) operation is started. Next, the video count value corresponding to images to be printed is inputted from the controller 103 to the CPU 101 in Step S102. Still further, an integrated number of printed sheets (cumulative number of prints) (A) stored in the memory tag 102 and the integrated Duty value (cumulative Duty value) (B) are read into the CPU 101 per each color in Steps S103 and S104, and the CPU 101 determines that the integrated Duty value (B) of which color is greater than 600% (more than the second threshold value) or not per every each color in Step S105.

If the integrated Duty value (B) of either color is more than 600%, i.e., Yes in Step S105, the CPU 101 judges whether or not the remaining number of prints of the printing job is zeroed in Step S106. Then, if the remaining number of prints is zero, i.e., Yes in Step S106, the CPU 101 shifts the process to the post-rotating operation, and forms the patch image of each color in the non-image area and executes the idling mode in succession (the second mode) in Step S107. That is, if the integrated Duty value (B) becomes 600%, i.e., the second threshold value, or more when the integrated number of prints (A) is less than 60 sheets, i.e., before becoming the first threshold value of 60 sheets, the CPU 101 executes the second mode of forming the patch image in the non-image area and of executing the idling mode.

After finishing the formation of the patch image and the idling mode, the integrated number of printed sheets within the memory tag 102 and the integrated Duty value, i.e., the values related to the toner replenishing amount, are reset to zero in Step S108, the CPU 101 shifts the process to the normal post-rotating operation in Step S109. After finishing the post-rotating operation, the CPU 101 turns OFF the developing drive in Step S110 and stops the operations of the body to finish the series of jobs.

Figure 11:
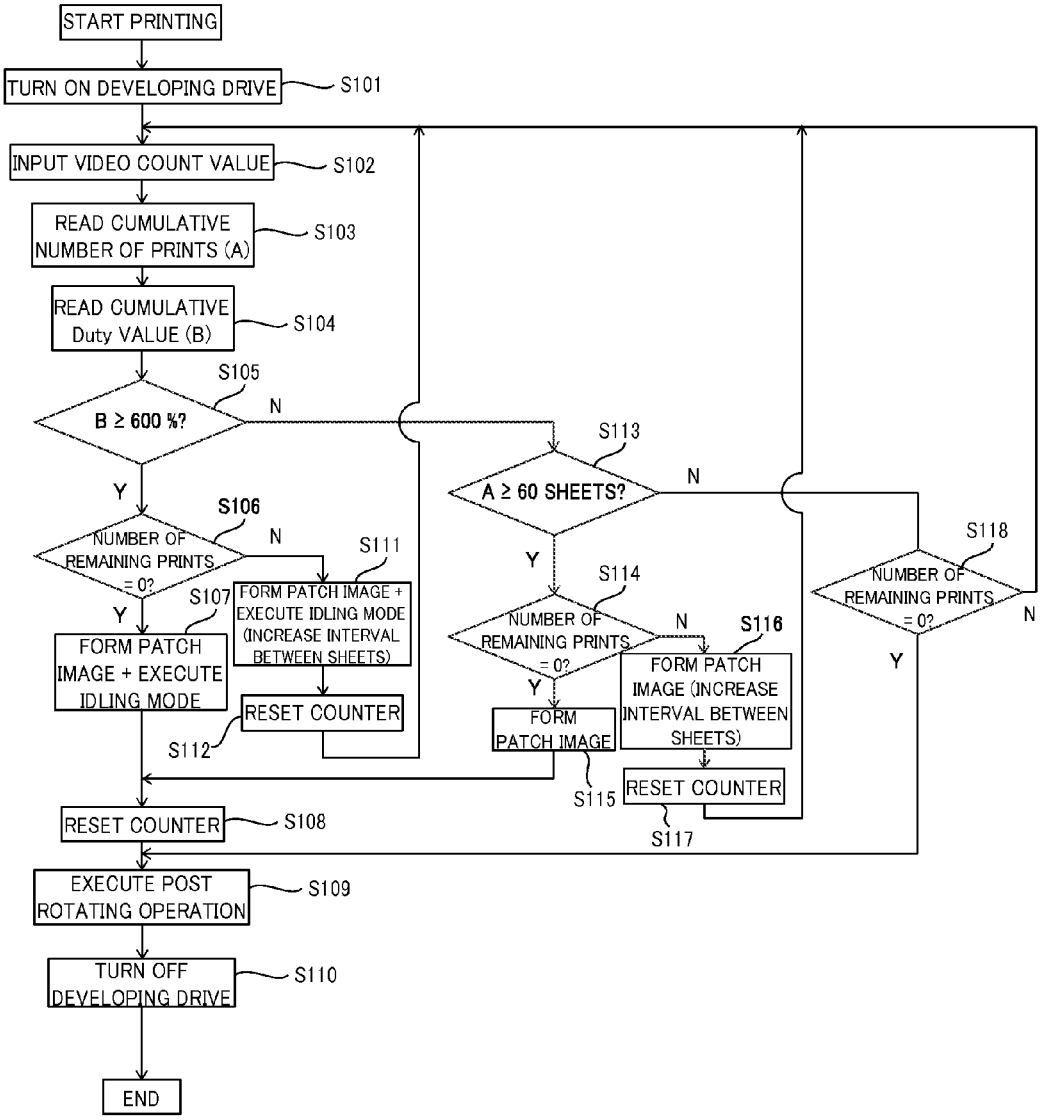
FIG. 11 is a control flowchart in conducting the idling mode according to the embodiment of the present invention.

Still further, if the number of remaining prints in the job is not zero in Step S106 in FIG. 11, i.e., No in Step S106, the CPU 101 widens the inter-sheet space, i.e., a space between a next image more than normal one and executes the second mode of forming the patch image and of executing the idling mode similarly to Step S107. After finishing the idling mode, the integrated number of printed sheets within the memory tag 102 and the integrated Duty value of the color of which the integrated Duty value is more than 600% are reset to zero in Step S112, the CPU 101 shifts the process to the next image forming operation (returns to Step S102).

Meanwhile, the CPU 101 determines in Step S113 whether or not the integrated number of prints (A) is more than 60 sheets (more than the first threshold value) when the integrated Duty value (B) is less than 600% (before becoming the second threshold value of 600%), i.e., No in Step S105. If the integrated number of prints (A) is more than 60 sheets, i.e., Yes in Step S113, the CPU 101 judges whether or not the remaining number of prints of the printing job is zeroed in Step S114. Then, if the number of remaining prints is zero, i.e., Yes in Step S114, the CPU 101 shifts the process to the post-rotating operation and executes the first mode of forming the patch image of each color without executing the idling mode during the interruption of the image forming operation in Step S115. After that, the process is shifted to Step S108.

If the number of remaining prints of the job is not zero, i.e., No in Step S114 in FIG. 11, the CPU 101 widens the inter-sheet space, i.e., a space with a next image, more than a normal one and forms the patch image without executing the idling mode in Step S116 in the same manner with Step S115. Then, at least the integrated number of prints in the memory tag 102 is reset to zero in Step S117 and the CPU 101 shifts the process to a formation of a next image (return to Step S102). It is noted that only the integrated number of prints is reset and the integrated Duty value is not reset in a case when priority is given to image quality. It is possible to improve the image quality because it becomes easy to shift to the second mode in Step S105 by not resetting the integrated Duty value as described above. Meanwhile, the priority is given to productivity, both of the integrated number of prints and the integrated Duty value are reset. It is possible to reduce frequency of the formation of the patch image and to improve the productivity by resetting both integrated values.

Still further, the CPU 101 judges whether or not the number of remaining prints of the printing job is zeroed in Step S118 when the integrated number of prints (A) is less than 60 sheets, i.e., No in Step S113. Then, when the number of remaining prints is zero, i.e., Yes in Step S118, the CPU 101 shifts the process to the post-rotating operation in Step S109. Meanwhile, if the number of remaining prints is not zero, i.e., No in Step S118, the process is returned to Step S102.

It is possible to suppress fluctuation of hue caused by fluctuation of toner electrification amount because the toner concentration can be corrected quickly by forming the patch image by using the integrated Duty value (integrated video count value) as the trigger in the case of the present embodiment. In the same time, it is possible to reduce the number of agglomerates efficiently without causing useless downtime by executing the second mode including the idling mode at adequate timing. This arrangement makes it possible to efficiently prevent the smeared image otherwise caused by the toner agglomerates reaching to the developing sleeve as they are and to provide the image forming apparatus capable of stably providing high quality images.

That is, in a case when the patch image is formed by a trigger that the integrated Duty value has become more than the second threshold value, images with relatively high image ratio are consecutively printed immediately before that. Therefore, in the case when the toner container 7 contains a large number of agglomerates of the toner, the smeared images are liable to be produced as described above. Therefore, the second mode of performing the idling mode in succession after forming the patch image is executed in this case.

It becomes possible to suppress the smeared images caused by the agglomerates of the toner from being produced by performing the idling mode by executing the second mode. At this time, the idling mode may be performed only on the developing device of a color whose integrated Duty value has become more than the second threshold value or the idling mode of all the colors may be performed.

It is possible to suppress the downtime by performing the idling mode after forming the patch image in succession as described above. That is, cleaning of the patch image on the intermediate transfer belt 5 and of the secondary transfer roller 10 is carried out after forming the patch image. The idling mode is performed during the time when the cleaning is carried out in the present embodiment, so that the downtime can be suppressed more than a case of forming the patch image after performing the idling mode for example.

However, it is possible to arrange such that the patch image is formed after performing the idling mode in succession in the second mode. This arrangement makes it possible to suppress the smears caused by the toner agglomerates from overlapping on the patch image even though the downtime is prolonged more than the case described above. If the smears overlap on the patch image, it becomes difficult to accurately detect the concentration of the patch image. Accordingly, it is possible to accurately detect the concentration of the patch image by performing the idling mode and the formation of the patch image in the sequence described above.

While the formation of the patch image is carried out in the same manner in a case when the integrated number of prints (A) of either color is more than the first threshold value, though the integrated Duty value (B) is less than the second threshold value, the idling mode is not performed in the case of the present embodiment. A case when the integrated number of prints (A) that has become more than the first threshold value becomes the trigger means that images with relatively low image ratio are printed consecutively immediately before that, so that the toner replenishing amount per unit sheet is small and the risk of causing the smears caused by the agglomerates is small. Then, the idling mode for crushing the agglomerate is not performed to minimize the downtime in this case.

It is noted that the patch image may be formed at an area (non-image area) deviating widthwise from a normal image. For instance, the patch image may be formed at widthwise end portions of the intermediate transfer belt 5 and the concentration sensor 800 may be disposed at a position facing the widthwise end portions. However, the idling mode is performed in the non-image area such as the inter-sheet space where no image is formed in this case also.

Still further, while the second threshold value of the integrated Duty value (B) is set at 600% and the first threshold value of the integrated number of prints (A) is set at 60 sheets in the explanation described above, those threshold values are not limited to those values. That is, optimum values may be used as those threshold values depending on an image forming apparatus to be used, on a configuration of the developer container or on a type and others of the developer to be used.

The present embodiment may be also arranged so as to execute the first and second modes based on the average image ratio of images most recently printed similarly to the first modified example. Still further, the present embodiment may be arranged such that the idling time is changed corresponding to the average image ratio similarly to the second modified example. In this case, the CPU 101 calculates the average image ratio per every most recent 10 or 50 sheets for example and judges whether or not the average image ratio thereof is more than the second threshold value. Then, the CPU 101 executes the second mode if the average image ratio becomes more than the second threshold value before when the integrated number of prints becomes 60 or 100 sheets, i.e., the first threshold value. Meanwhile, the CPU 101 executes the first mode if the integrated number of prints becomes more than the first threshold value before when the average image ratio thereof becomes the second threshold value. It is possible to combine with the forcible replenishing mode similarly to the first and second modified examples in the embodiment. The other components and effects are the same with those of the first modified example.

<Other Embodiment>

While the integrated average image ratio or the integrated video count value (integrated Duty value) are used as the value related to the toner replenishing amount in the embodiment described above, the integrated values are not limited to those values. For instance, a number of rotations or a rotating time of the replenishing member 81 may be used as the value related to the toner replenishing amount. It is noted that if rotational speed of the replenishing member 81 is known, it is possible to calculate the number of rotations based on the rotational speed and the rotating time. In short, it is just necessary to know that a large amount of toner is replenished in a short period of time. Still further, the value related to the number of image forming sheets may be a value from which it is possible to know how may images have been formed such as a number of rotations and rotating time of the developing sleeve 42 for example beside the integrated number of prints.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-029512, filed Feb. 19, 2014 which is hereby incorporated by reference herein in its entirety.

What is claimed is:

1. An image forming apparatus comprising:

an image carrier;

a developing apparatus configured to develop an electrostatic latent image formed on the image carrier by a toner at a developing position and forming a toner image;

wherein the developing apparatus including:

a developer container configured to store a developer containing the toner and a carrier; and an agitating member rotating and agitating the developer within the developer container;

a developer replenishing apparatus configured to replenish the developer to the developer container corresponding to a toner consumption amount;

a control portion configured to selectively execute first and second modes, the first mode being a mode of forming a controlling toner image between a succeeding image and a preceding image in a case when a number of recording media is more than a predetermined threshold value during a consecutive image forming job in which images are formed consecutively on recording media, and the second mode being a mode of driving the agitating member between a succeeding image and a preceding image in a case when an integrated value of values related to a toner replenishing amount is greater than the predetermined threshold value during the consecutive image forming job, wherein a total number of rotations of the agitating member in a period until when the succeeding image reaches the developing position after when the preceding image passes the developing position in the second mode is greater than a total number of rotations of the agitating member in the first mode; and a resetting portion resetting the integrated value in a case when the first mode or the second mode is executed.

2. The image forming apparatus according to claim 1, wherein the control portion increases a time for driving the agitating member in the second mode more than that in the first mode.

3. The image forming apparatus according to claim 1, wherein the control portion adopts a video counter value of an image to be formed as the value related to the toner replenishing amount.

4. The image forming apparatus according to claim 1, wherein the control portion forms the controlling toner image in the second mode.

5. The image forming apparatus according to claim 1, wherein the control portion calculates a cumulative number of recording media on which images have been formed and executes the first mode without executing the second mode in a case when the values related to the toner replenishing amount are less than the predetermined threshold value and the cumulative number of recording media is greater than a predetermined threshold value.

6. The image forming apparatus according to claim 1, wherein the control portion quickens driving speed of the agitating member in the second mode to be faster than that of the first mode.

7. The image forming apparatus according to claim 1, wherein the developer replenishing apparatus includes a toner container storing toner and a replenishing member configured to rotate to replenish the toner from the toner container to the developer container, and wherein the control portion adopts a number of rotations of the replenishing member as the value related to the toner replenishing amount.

8. The image forming apparatus according to claim 1, wherein the developing apparatus includes:

a developer carrier configured to carry the developer agitated by the agitating member, to transfer the toner of the developer to the image carrier and to develop the electrostatic latent image formed on the image carrier; and a driving source driving the developer carrier and the agitating member: and wherein the control portion controls the number of rotations of the agitating member by controlling the driving source.

9. The image forming apparatus according to claim 2, wherein the control portion calculates an average image ratio which is an image ratio per sheet of a predetermined number of image forming sheets, and the larger the average image ratio, the more the control portion delays starting of formation of the succeeding electrostatic latent image.

* * * * *